United States Patent [19]

Brusako et al.

[11] 4,072,512

[45] Feb. 7, 1978

[54] CHARGE FOR MANUFACTURING ALUMINIUM-SILICON ALLOYS

[76] Inventors: Jury Ivanovich Brusako, Novo-Izmailovksy prospekt, 37, kv. 42; Sergei Alexandrovich Rzhavin, 17 Iinia, 18, kv. 94; Vasily Pavlovich Kiselev, ulitsa Lensoveta, 48, kv. 10; Mikhail Sergeevich Tarasov, ulitsa Shevchenko, 24, kv. 32; Vladimir Mendeleevich Rapoport, ulitsa Bulvarnaya, 117, kv. 12; Vladimir Vasilievich Timofeev, Gavanskaya ulitsa, 37, kv. 39, all of Leningrad; Raisa Ivanovna Ragulina, prospekt Metallurgov, 21, kv. 40, Zaporozhie; Miro Khristoforovich Alivoivodich, ulitsa 40 let Sovetskoi Ukrainy, 46, kv. 21, Zaporozhie; Anatoly Gavrilovich Kucherenko, prospekt Lenina, 192, kv. 159, Zaporozhie; Anatoly Mikhailovich Varjushenkov, prospekt Shaumiana, 52/1, kv. 45; Elena Pavlovna Isaeva, ulitsa P.Lavrova, 62, kv. 3, both of Leningrad; Ivan Arkhipovich Berezhnoi, ulitsa Patrioticheskaya, 15, kv. 20, Zaporozhie; Vasily Petrovich Rumyantsev, ulitsa Sportivnaya, 25, kv. 62, Zaporozhie; Grigory Safronovich Shpak, ulitsa Tennisnaya, 16, kv. 9, Zaporozhie; Dmitry Semenovich Guz, ulitsa Levoberezhnaya, 14, kv. 5, Zaporozhie; Dmitry Vladimirovich Ilinkov, ulitsa Tregubenko, 13, kv. 5, Zaporozhie; Pavel Ilich Volpin, prospekt Lenina, 210, kv. 16, Zaporozhie; Mikhail Pavlovich Avdeev, 7 kvartal, 30, kv. 7, Shelekhov, Irkutskoi oblasti; Stanislav Arsentievich Artemenko, prospekt Stalevarov, 25a, kv. 27, Zaporozhie; Ljudmila Pavlovna Khrennikova, ulitsa Dzerzhinskogo, 70, kv. 5, Leningrad, all of U.S.S.R.

[21] Appl. No.: 691,519

[22] Filed: June 1, 1976

Related U.S. Application Data

[63] Continuation of Ser. No. 591,696, June 30, 1975, abandoned, which is a continuation of Ser. No. 174,532, Aug. 24, 1971, abandoned.

[30] Foreign Application Priority Data

| | | |
|---|---|---|
| Nov. 11, 1970 | U.S.S.R. | 1485663 |
| Nov. 11, 1970 | U.S.S.R. | 1485661 |
| Nov. 11, 1970 | U.S.S.R. | 1485659 |

[51] Int. Cl.[2] ..... C22C 21/02

[52] U.S. Cl. ..... 75/148; 75/10 R; 75/68 A

[58] Field of Search ..... 75/68 AR, 3, 4, 5, 10 R, 75/148, 135, 148, 68 A; 252/188.3

[56] References Cited

U.S. PATENT DOCUMENTS

| | | | |
|---|---|---|---|
| 2,867,525 | 1/1959 | Loerenstein | 75/3 |
| 3;135,696 | 6/1964 | Ruelle | 252/188.3 |
| 3,307,927 | 3/1967 | Muschenborn et al. | 75/3 |
| 3,661,562 | 5/1972 | Seth et al. | 75/68 R |

FOREIGN PATENT DOCUMENTS

| | | | |
|---|---|---|---|
| 12,648 of | 1889 | United Kingdom | 75/68 A |

*Primary Examiner*—M. J. Andrews
*Attorney, Agent, or Firm*—Holman & Stern

[57] ABSTRACT

A charge comprising a silica-alumina material and a carbonaceous reducing agent which comprises a mixture of petroleum coke and carbon black.

4 Claims, No Drawings

CHARGE FOR MANUFACTURING ALUMINIUM-SILICON ALLOYS

This is a continuation of application Ser. No. 591,696 filed June 30, 1975 which in turn is a Continuation of Ser. No. 174,532 filed Aug. 24, 1971, both of which are now abandoned.

The present invention relates to electrothermal production of aluminium-silicon alloys, and more particularly to a charge for manufacturing aluminium-silicon alloys containing 55–68% of aluminium and 44–31% of silicon to be further processed into constructional or deformable alloys. The present invention may be also advantageously used in manufacturing silicoaluminium employed for deoxidizing steel and as a reducing agent for metallothermal processes of manufacturing various metals. Furthermore, the invention may be used in other similar arts of electrothermal production, such as in manufacturing industrial silicon, silicocalcium and low-iron ferrous alloys.

Known in the art is a charge for manufacturing aluminium-silicon alloys comprising a silica-alumina material, a carbonaceous reducing agent and a binder.

The prior art charge in which only charcoal is used as the reducing agent has unsatisfactory briquetting capacity, requires a substantial amount of binder to be added and considerably complicates the transfer and technological system of charge preparation due to the formation of a great quantity of fines and breakage of briquettes. An essential disadvantage of this charge also resides in its high cost and in criticality of charcoal.

A charge in which only coals of the lowest metamorphism stage are used as the reducing agent substantially contaminates the aluminium-silicon alloys being produced with iron and titanium impurities due to a high ash content of the coals, which fact cuts the yield of a marketable product in the course of ultimate metallurgical processing of primary alloys.

A general disadvantage of the charges in which charcoal or coal is used as the reducing agent without addition of carbonaceous degreasers to the charge is the very limited possibility of the use thereof in manufacturing aluminium silicon alloys in commercial electric furnaces.

The charges of this type are characterized by low caking capacity resulting in a spontaneous avalanching of the charges and in drastic deterioration of performance characteristics when used in commercial electric furnaces having high specific power at the electrodes.

Alcohol-sulphite lye based on calcium used as the binder leads to contamination of the alloys being produced with calcium impurity, intensification of slag formation and reduced yields in refining the alloys from non-metallic impurities.

It is a primary object of the present invention to provide a charge for manufacturing aluminium-silicon alloys which possesses optimum caking capacity and gas permeability on the furnace top, which fact provides, in turn, for uniform descent of the charge and contributes to reduction of slag formation in the furnace with an increase of the yield of aluminium-silicon alloy.

Another object of the invention is to provide a charge which ensures a lower content of iron and titanium contaminants in the primary alloy.

These and other objects are accomplished by a change for manufacturing aluminium-silicon alloys, comprising a silica-alumina material and a carbonaceous reducing agent, wherein, according to the present invention, a mixture of petroleum coke and carbon black is used as the carbonaceous reducing agent. Most advantageous is a charge in which the ratio of petroleum coke to carbon black as referred to non-volatile carbon content of the charge ranges within the limits of from 3.0:1 to 0.5:1 respectively.

In order to lower calcium contamination of the charge, which would otherwise contribute to slag formation and reduction of the yield of refined alloy as to the principal components thereof, it is advantageous to use as a binder alcohol-sulphite lye based on cations selected from the group consisting of sodium, magnesium, and ammonium.

In order to reduce the content of iron and titanium impurities in the primary alloy by the elimination thereof during the ore-reducing fusion to facilitate further technological processes and to increase the yield of desired products (casting and constructional alloys, as well as silumins), it is advantageous to use in the charge, chlorides and fluorides of alkali and/or alkaline-earth metals taken in combination or individually in an amount of up to 3% by weight of the charge.

The present invention will now be described with reference to a specific embodiment thereof.

A charge for manufacturing aluminium-silicon alloys comprises a mixture of crushed charge materials, namely, a silica-alumina raw material, a carbonaceous reducing agent, a binder and additives comprising chlorides or fluorides of alkali and/or alkaline-earth metals, the charge being lumped by briquetting or granulating and dried to have a residual moisture content of less than 1%. Used as the silica-alumina raw material may be kaolins, kyanites, disthene-sillimanites and other silica-alumina materials containing less than 0.7–1% of iron and less than 0.6–0.7% of titanium when mixed. Used as the carbonaceous reducing agent is a mixture of petroleum or pitch coke and carbon black in a ratio of 3.0–0.5:1 as referred to non-volatile carbon contained in the charge, which corresponds to introduction into the charge of from 25% to 67% of carbon black by total content of non-volatile carbon in the charge.

Used as the binder is alcohol-sulphite lye based on a cation of sodium, magnesium or ammonium. Furthermore, in order to reduce the content of iron and titanium impurities in the alloy during the ore-reducing fusion process, chlorides and fluorides of alkali and/or alkaline-earth metals are added to the charge. The above-mentioned components of the charge are crushed, batched according to predetermined ratios, mixed and lumped (by granulating or briquetting). The lumped charge is then dried to have a residual moisture content of less than 1% and fed into an ore-reducing electric furnace.

Depending on the specific electric power at the furnace electrodes, necessary weight ratios of the carbonaceous reducing agents in the charge are chosen in such a manner that the total carbon content in the charge will be 96%–100% of the stoichiometric quantity required for reducing charge oxides into metals.

The specific examples illustrating the embodiment of the present invention are given hereinbelow.

EXAMPLE 1

A charge was calculated according to an alloy containing 60% of Al to be produced in an ore-reducing furance.

| Composition of the charge (kg.): | |
|---|---|
| kaolin | 100.0 |
| alumina | 38.84 |
| carbon black | 22.75 |
| petroleum coke | 24.55 |
| binder | 9.8 |

In the above composition the ratio of the contents of non-volatile carbon in the charge in carbon black to petroleum coke was 1:1 which corresponds to the addition of carbon black into the charge in an amount of 50% by total content of non-volatile carbon in the charge introduced with carbon black and petroleum coke.

The above composition of the charge ensured the stable performance conditions of the electric furnace at the specific power thereof of from 3,000 to 3,500 kw/m$^2$ as referred to the electrode cross-sectional area. In this case the content of iron in the diluted alloy was up to 0.47% and titanium up to 0.14%, while a yield upon filtering such alloys was not less than 94%.

EXAMPLE 2

A charge was calculated according to an alloy containing 60% of Al.

| Composition of the charge (kg.): | |
|---|---|
| kaolin | 100.0 |
| alumina | 38.84 |
| carbon black | 15.05 |
| petroleum coke | 32.80 |
| binder | 9.84 |
| | 196.53 |

In the above composition of the charge the ratio of petroleum coke to carbon black was 2.0:1.0 which corresponds to the ratio of 67:33 by weight of nonvolatile carbon in the mixture of the reducing agents.

This ratio between the reducing agents ensured the stable performance conditions of the electric furnace with high specific power on the electrodes (more than 3,500 kw/m$^2$). When using these reducing agents, the content of iron in the diluted alloy was up to 0.52% and titanium up to 0.15%.

The yield of desired product upon filtering such alloys was not less than 93.2%.

EXAMPLE 3

A charge was calculated according to an alloy containing 60% of Al.

| Composition of the charge (kg.): | |
|---|---|
| kyanite concentrate | 100 |
| carbon black | 15.6 |
| petroleum coke | 16.84 |
| alcohol-sulphite lye based on cation of sodium | 7.0 |

The alloy produced from this charge contained 0.5% abs. less of calcium impurity as compared to an alloy produced when using the charge containing a binder based on calcium.

Accordingly, in refining the primary alloy produced from the above charge the yield was increased by 1.5%.

EXAMPLE 4

Charges were calculated according to an alloy containing 60% of Al.

| a) Composition of the charge (kg.): | |
|---|---|
| kyanite concentrate | 100.0 |
| carbon black | 15.6 |
| petroleum coke | 16.84 |
| binder | 7.0 |
| sodium fluoride | 4.6 |
| b) Composition of the charge (kg.): | |
| kyanite concentrate | 100.0 |
| carbon black | 15.6 |
| petroleum coke | 16.84 |
| binder | 7.0 |
| sodium chloride | 4.6 |

The aluminium-silicon alloy produced from the above charges contained 15–25%pu less of iron and titanium impurities as compared to an alloy fused from similar charges but having no chloride and fluoride additives. In this case power and charge consumption was reduced by 1.5%–2% per 1t of the refined alloy.

The charge according to the invention ensured stabilization of the performance conditions of furnaces at elevated capacity, reduction of calcium content in the alloy by 0.5% abs. and lower content of iron and titanium impurities in the alloy being produced both due to the use of purer carbonaceous reducing agent and the introduction of chlorides and fluorides of alkali and alkaline-earth into the charge.

The above-mentioned improvements result in a reduction of the specific power consumption per 1t of desired product, an increase of the yield of the primary alloy due to reduction of the content of calcium impurity in the alloy, as well as an increase in the yield upon filtering the diluted alloys due to lower content of iron and titanium impurities in the alloy.

We claim:

1. A charge for manufacturing aluminium-silicon alloys, comprising a silica-alumina material and a carbonaceous reducing agent which comprises a mixture of petroleum coke and carbon black, the ratio of petroleum coke to carbon black, as referred to non-volatile carbon content in the charge, ranges from 3.0:1 to 0.5:1.

2. The charge according to claim 1, further comprising alcohol-sulphite lye based on cations selected from the group consisting of sodium, magnesium, and ammonium.

3. The charge according to claim 1, further comprising chlorides of alkali and alkaline-earth metals in an amount of up to 3% by total weight of the charge.

4. The charge according to claim 1, further comprising fluorides of alkali and alkaline-earth metals in an amount of up to 3% by total weight of the charge.

* * * * *